US008290167B2

(12) United States Patent
Pulkki et al.

(10) Patent No.: US 8,290,167 B2
(45) Date of Patent: Oct. 16, 2012

(54) METHOD AND APPARATUS FOR CONVERSION BETWEEN MULTI-CHANNEL AUDIO FORMATS

(75) Inventors: Ville Pulkki, Espoo (FI); Juergen Herre, Buckenhof (DE)

(73) Assignee: Fraunhofer-Gesellschaft zur Foerderung der Angewandten Forschung E.V., Munich (DE)

( * ) Notice: Subject to any disclaimer, the term of this patent is extended or adjusted under 35 U.S.C. 154(b) by 1338 days.

(21) Appl. No.: 11/742,502

(22) Filed: Apr. 30, 2007

(65) Prior Publication Data

US 2008/0232616 A1 Sep. 25, 2008

(51) Int. Cl.
*H04R 5/00* (2006.01)

(52) U.S. Cl. ..... 381/23; 381/22; 381/119

(58) Field of Classification Search ..... 381/1, 17–19, 381/22, 23, 310, 92, 119
See application file for complete search history.

(56) References Cited

U.S. PATENT DOCUMENTS

| | | | | |
|---|---|---|---|---|
| 5,208,860 | A | 5/1993 | Lowe et al. | |
| 5,812,674 | A | 9/1998 | Jot | |
| 5,870,484 | A | 2/1999 | Greenberger | |
| 5,873,059 | A | 2/1999 | Iijima et al. | |
| 5,909,664 | A | 6/1999 | Davis et al. | |
| 6,343,131 | B1 | 1/2002 | Huopaniemi | |
| 6,628,787 | B1 | 9/2003 | McGrath et al. | |
| 6,694,033 | B1 | 2/2004 | Rimell et al. | |
| 6,718,039 | B1 | 4/2004 | Klayman et al. | |
| 6,836,243 | B2 | 12/2004 | Kajala et al. | |
| 7,110,953 | B1 | 9/2006 | Edler et al. | |
| 7,243,073 | B2 | 7/2007 | Yeh et al. | |
| 7,668,722 | B2 * | 2/2010 | Villemoes et al. | 704/500 |
| 7,853,022 | B2 * | 12/2010 | Thompson et al. | 381/17 |
| 2004/0091118 | A1 | 5/2004 | Griesinger | |
| 2004/0151325 | A1 | 8/2004 | Hooley et al. | |
| 2005/0053242 | A1 | 3/2005 | Henn et al. | |
| 2005/5249367 | | 11/2005 | Bailey | |
| 2006/0004583 | A1 | 1/2006 | Herre | |
| 2006/0093128 | A1 | 5/2006 | Oxford | |
| 2006/0093152 | A1 | 5/2006 | Thompson et al. | |
| 2007/0127733 | A1 | 6/2007 | Henn et al. | |
| 2007/0269063 | A1 * | 11/2007 | Goodwin et al. | 381/310 |

FOREIGN PATENT DOCUMENTS

| | | |
|---|---|---|
| EP | 1016320 A2 | 7/2000 |
| EP | 1016320 B1 | 7/2000 |
| EP | 1275272 A1 | 1/2003 |
| EP | 1761110 | 3/2007 |
| JP | 06-506092 | 7/1994 |

(Continued)

OTHER PUBLICATIONS

Lipshitz, Stanley P., "Stereo Microphone Techniques . . . Are the Purists Wrong?," Sep. 1986, Journal of the Audio Engineering Society, vol. 34, No. 9, pp. 716-744.

(Continued)

*Primary Examiner* — Xu Mei
(74) *Attorney, Agent, or Firm* — Michael A. Glenn; Glenn Patent Group

(57) ABSTRACT

An input multi-channel representation is converted into a different output multi-channel representation of a spatial audio signal, in that an intermediate representation of the spatial audio signal is derived, the intermediate representation having direction parameters indicating a direction of origin of a portion of the spatial audio signal; and in that the output multi-channel representation of the spatial audio signal is generated using the intermediate representation of the spatial audio signal.

23 Claims, 5 Drawing Sheets

FOREIGN PATENT DOCUMENTS

| | | | |
|---|---|---|---|
| JP | 07-222299 | | 8/1995 |
| JP | 10-304498 | | 11/1998 |
| JP | 2003-274492 | | 9/2003 |
| JP | 2004-504787 | | 2/2004 |
| JP | 2006-087130 | | 3/2006 |
| JP | 2006-237839 | | 9/2006 |
| JP | 2007-533221 | | 11/2007 |
| KR | 10-2007-0001227 | | 1/2007 |
| KR | 10-2007-0042145 | | 4/2007 |
| RU | 2092979 | C1 | 10/1997 |
| RU | 2129336 | C1 | 4/1999 |
| RU | 2234819 | C2 | 8/2004 |
| RU | 2234819 | C2 | 8/2004 |
| TW | I236307 | | 2/2004 |
| TW | 200629240 | | 8/2006 |
| WO | 92/15180 | | 9/1992 |
| WO | WO 01/82651 | | 11/2001 |
| WO | 02/07481 | A2 | 1/2002 |
| WO | 2004/077884 | A1 | 9/2004 |
| WO | WO 2004/077884 | | 9/2004 |
| WO | 2005/101905 | A1 | 10/2005 |
| WO | WO2005117483 | | 12/2005 |
| WO | 2006/003813 | | 1/2006 |

OTHER PUBLICATIONS

Gerzon, Michael A., "Periphony: With-Height Sound Reproduction," Jan./Feb. 1973, Journal of the Audio Engineering Society, vol. 21, No. 1, pp. 2-10.

Laborie, Arnaud, et al., "Designing High Spatial Resolution Microphones," Oct. 28-31, 2004, Journal of the Audio Engineering Society, Convention Paper 6231, San Francisco, CA.

Merimaa, Juha, et al., "Spatial Impulse Response Rendering I: Analysis and Synthesis," Dec. 2005, Journal of the Audio Engineering Society, vol. 53, No. 12, pp. 1115-1127.

Pulkki, Ville, et al., "Directional Audio Coding: Filterbank and STFT-based Design," May 20-23, 2006, Journal of the Audio Engineering Society, AES 120$^{th}$ Convention, Paris, France, Preprint 6658.

Nelisse, H., et al., "Characterization of a Diffuse Field in a Reverberant Room," Jun. 1997, Journal of the Acoustical Society of America, vol. 101, No. 6, pp. 3417-3524.

Okano, Toshiyuki, et al., "Relations Among Interaural Cross-Correlation Coefficient (IACCe), Lateral Fraction (LFe), and Apparent Source Width (ASW) in Concert Halls," Jul. 1998, Journal of the Acoustical Society of America, pp. 255-265.

Pulkki, Ville, et al., "Spatial Impulse Response Rendering II: Reproduction of Diffuse Sound and Listening Tests," Jan./Feb. 2006, Journal of the Audio Engineering Society, vol. 54, No. 1/2, pp. 3-20.

Atal, B.S., et al., "Perception of Coloration in Filtered Gaussian Noise—Short-Time Spectral Analysis by the Ear," Aug. 21-28, 1962, Fourth International Congress on Acoustics, Copenhagen.

Culling, John F., et al., "Dichotic Pitches as Illusions of Binaural Unmasking," Jun. 1998, Journal of the Acoustical Society of America, pp. 3509-3526.

Bruggen, Marc, et al., "Coloration and Binaural Decoloration in Natural Environments," Apr. 19, 2001, Acustica, vol. 87, pp. 400-406.

Faller, Christof, et al., "Source Localization in Complex Listening Situations: Selection of Binaural Cues Based on Interaural Coherence," Nov. 2004, Journal of the Acoustical Society of America, vol. 116, No. 5, pp. 3075-3089.

Pulkki, Ville, "Virtual Sound Source Positioning Using Vector Base Amplitude Panning," Jun. 1997, Journal of the Audio Engineering Society, vol. 45, No. 6.

Schulein, Robert B., "Microphone Considerations in Feedback-Prone Environments," Jul./Aug. 1976, Journal of the Audio Engineering Society, vol. 24, No. 6.

Avendano, Carlos, "A Frequency-Domain Approach to Multichannel Upmix," Jul./Aug. 2004, Journal of the Audio Engineering Society, vol. 52, No. 7/8.

Dressler, Roger, "Dolby Surround Pro Logic II Decoder—Principles of Operation," Aug. 2004, Dolby Publication, http:.www.dolby.com/assets/pdf/tech_library/209_Dolby_Surround_Pro_Logic_II_Decoder_Principles_of_Operation.pdf.

Avendano, Carlos, et al., "Ambience Extraction and Synthesis from Stereo Signals for Multi-Channel Audio Up-Mix," 2002, Creative Advanced Technology Center.

Bitzer, Joerg, et al., "Superdirective Microphone Arrays," in M. Brandstein, D. Ward edition: Microphone Arrays—Signal Processing Techniques and Applications, Chapter 2, Springer Berlin 2001, ISBN: 978-3-540-41953-2.

Faller, Christof, "Multiple-Loudspeaker Playback of Stereo Signals," Nov. 2006, Journal of the Audio Engineering Society, vol. 54, No. 11.

Griesinger, David, "Multichannel Matrix Surround Decoders for Two-Eared Listeners," Nov. 8-11, 1996; Journal of the Audio Engineering Society, 101$^{st}$ AES Convention, Los Angeles, California, Preprint 4402.

Villemoes, Lars, et al., "MPEG Surround: The Forthcoming ISO Standard for Spatial Audio Coding," Jun. 30-Jul. 2, 2006, AES 28$^{th}$ International Conference, Pitea, Sweden.

Pulkki, V., "Directioinal Audio Coding in Spatial Sound Reproduction and Stereo Upmixing;" Jun. 30-Jul. 2, 2006, Proceedings of the AES 28$^{th}$ International Conference, pp. 251-258, Pitea, Sweden.

Itu-R. Rec. BS.775-1, "Multi-Channel Stereophonic Sound System With or Without Accompanying Picture," 1992-1994, International Telecommunications Union, Geneva, Switzerland.

Simmer, K. Uwe, et al., "Post Filtering Techniques," in M. Brandstein, D. Ward edition: Microphone Arrays—Signal Processing Techniques and Applications, Chapter 3, Springer Berlin 2001, ISBN: 978-3-540-41953-2.

Streicher, Ron, et al., "Basic Stereo Microphone Perspectives—A Review," Jul./Aug. 1985, Journal of the Audio Engineering Society, vol. 33, No. 7/8.

Chen, Jingdong, et al., "Time Delay Estimation in Room Acoustic Environments: An Overview," 2006, EURASIP Journal on Applied Signal Processing, vol. 2006, Articale 26503, pp. 1-19.

Zielinski, Slawomir K., "Comparison of Basic Audio Quality and Timbral and Spatial Fidelity Changes Caused by Limitation of Bandwidth and by Down-mix Algorithms in 5.1 Surround Audio Systems," Mar. 2005, Journal of the Audio Engineering Society, vol. 53, No. 3.

Elko, Gary W., "Superdirectional Microphone Arrays," in S.G. Gay, J. Benesty edition: "Acoustic signal Processing for Telecommunication," Chapter 10, Kluwer Academic Press, ISBN: 978-0792378143.

Bilsen, Frans A., "Pitch of Noise Signals: Evidence for a 'Central Spectrum'," 1977, Journal of the Acoustical Society of America, vol. 61, No. 1.

Bronkhorst, A.W., et al., "The Effectof Head-Induced Interaural Time and Level Differences on Speech Intelligibility in Noise," 1988, Journal of the Acoustical Society of America, vol. 83, pp. 1508-1516.

Bech, Soren, "Timbral Aspects of Reproduced Sound in Small Rooms. I," Mar. 1995, Journal of the Acoustical Society of America, vol. 97, No. 3, pp. 1717-1726.

Allen, Jont B., "Image Method for Efficiently Simulating Small-Room Acoustics," 1979, Journal of the Acoustical Society of America, vol. 65, pp. 943-950.

The Russian Decision to grant mailed Sep. 7, 2010 in related Russian Patent Application No. 2009134471/09(048571); 10 pages.

Daniel, J. et al.; "Ambisonics Encoding of Other Audio Formats for Multiple Listening Conditions"; Sep. 26-29, 1998; Presented at the105th AES Convention, San Franciso, California, 29 pages.

European Patent Office Correspondence, mailed Feb. 24, 2011, in related European Patent Application No. 08707513.1-2225, 6 pages.

Herre, et al.; "The Reference Model Architecture for MPEG Spatial Audio Coding": May 28, 2005, AES Convention paper, pp. 1-13; New York, NY, XP009059973.

Pulkki, V. , "Applications of Directional Audio Coding in Audio", 19th International Congress of Acoustics, International Commission for Acoustics, retrieved online from http://decoy.iki.fi/dsound/ambisonic/motherlode/source/rba-15-2002.pdf, Sep. 2007, 6 pages.

* cited by examiner

METHOD AND APPARATUS FOR CONVERSION BETWEEN MULTI-CHANNEL AUDIO FORMATS

FIELD OF THE INVENTION

The present invention relates to a technique as to how to convert between different multi-channel audio formats in the highest possible quality without being limited to specific multi-channel representations. That is, the present invention relates to a technique allowing the conversion between arbitrary multi-channel formats.

BACKGROUND OF THE INVENTION AND PRIOR ART

Generally, in multi-channel reproduction and listening, a listener is surrounded by multiple loudspeakers. Various methods exist to capture audio signals for specific setups. One general goal in the reproduction is to reproduce the spatial composition of the originally recorded sound event, i.e. the origins of individual audio sources, such as the location of a trumpet within an orchestra. Several loudspeaker setups are fairly common and can create different spatial impressions. Without using special post-production techniques, the commonly known two-channel stereo setups can only recreate auditory events on a line between the two loudspeakers. This is mainly achieved by so-called "amplitude-panning", where the amplitude of the signal associated to one audio source is distributed between the two loudspeakers, depending on the position of the audio source with respect to the loudspeakers. This is normally done during recording or subsequent mixing. That is, an audio source coming from the far-left with respect to the listening position will be mainly reproduced by the left loudspeaker, whereas an audio source in front of the listening position will be reproduced with identical amplitude (level) by both loudspeakers. However, sound emanating from other directions cannot be reproduced.

Consequently, by using more loudspeakers that are distributed around the listener, more directions can be covered and a more natural spatial impression can be created. The probably most well known multi-channel loudspeaker layout is the 5.1 standard (ITU-R775-1), which consists of 5 loudspeakers, whose azimuthal angles with respect to the listening position are predetermined to be 0°, ±30° and ±110°. That means, during recording or mixing, the signal is tailored to that specific loudspeaker configuration and deviations of a reproduction setup from the standard will result in decreased reproduction quality.

Numerous other systems with varying numbers of loudspeakers located at different directions have also been proposed. Professional and special systems, especially in theaters and sound installations, do also include loudspeakers at different heights.

A universal audio reproduction system named DirAC has been recently proposed which is able to record and reproduce sound for arbitrary loudspeaker setups. The purpose of DirAC is to reproduce the spatial impression of an existing acoustical environment as precisely as possible, using a multi-channel loudspeaker system having an arbitrary geometrical setup. Within the recording environment, the responses of the environment (which may be continuous recorded sound or impulse responses) are measured with an omnidirectional microphone (W) and with a set of microphones allowing to measure the direction of arrival of sound and the diffuseness of sound. In the following paragraphs and within the application, the term "diffuseness" is to be understood as a measure for the non-directivity of sound. That is, sound arriving at the listening or recording position with equal strength from all directions, is maximally diffuse. A common way to quantify diffusion is to use diffuseness values from the interval [0, . . . , 1], wherein a value of 1 describes maximally diffuse sound and value of 0 describes perfectly directional sound, i.e. sound emanating from one clearly distinguishable direction only. One commonly known method of measuring the direction of arrival of sound is to apply 3 figure-of-eight microphones (XYZ) aligned with Cartesian coordinate axes. Special microphones, so-called "SoundField microphones", have been designed, which directly yield all the desired responses. However, as mentioned above, the W, X, Y and Z signals may also be computed from a set of discrete omnidirectional microphones.

Another method to store audio formats for arbitrary number of channels to one or two downmix channels of audio with accompanying directional data has been recently proposed by Goodwin and Jot. This format can be applied to arbitrary reproduction systems. The directional data, i.e. the data having information about the direction of audio sources is computed using "Gerzon vectors", which consist of a velocity vector and an energy vector. The velocity vector is a weighted sum of vectors pointing at loudspeakers from the listening position, wherein each weight is the magnitude of a frequency spectrum at a given time/frequency tile for a loudspeaker. The energy vector is a similarly weighted vector sum. However, the weights are short-time energy estimates of the loudspeaker signals, that is, they describe a somewhat smoothed signal or an integral of the signal energy contained in the signal within finite length time-intervals. These vectors share the disadvantage of not being related to a physical or a perceptual quantity in a well-grounded way. For example, the relative phase of the loudspeakers with respect to each other is not properly taken into account. That means, for example, if a broadband signal is fed into the loudspeakers of a stereophonic setup in front of a listening position with opposite phase, a listener would perceive sound from ambient direction, and the sound field in the listening position would have sound energy oscillations from side to side (e.g. from the left side to the right side). In such a scenario, the Gerzon vectors would be pointing towards the front direction, which is obviously not representing the physical or the perceptual situation.

Naturally, having multiple multi-channel formats or representations in the market, the requirement exists to be able to convert between the different representations, such that the individual representations may be reproduced with setups originally developed for the reconstruction of an alternative multi-channel representation. That is, for example, a transformation between the 5.1 channels and 7.1 or 7.2 channels may be required to use an existing 7.1 or 7.2 channel playback setup for playing back the 5.1 multi-channel representation commonly used on DVD. The great variety of audio formats makes the audio content production difficult, as all formats require specific mixes and storage/transmission formats. Therefore, conversion between different recording formats for playback on different reproduction setups is necessary.

There are a number of methods proposed to convert audio in a specific audio format to another audio format. However, these methods are always tailored to specific multi-channel formats or representations. That is, these are only applicable to the conversion from one specific predetermined multi-channel representation into another specific multi-channel representation.

Generally, a reduction in the number of reproduction channels (so-called "downmix") is simpler to implement that an increase in the number of reproduction channels ("upmix"). For some standard loudspeaker reproduction setups, recommendations are provided by, for example, the ITU on how to downmix to reproduction setups with a lower number of reproduction channels. In these so-called "ITU" downmix equations, the output signals are derived as simple static linear combinations of input signals. Usually, a reduction of the number of reproduction channels leads to a degradation of the perceived spatial image, i.e. a degraded reproduction quality of a spatial audio signal.

For a possible benefit from a high number of reproduction channels or reproduction loudspeakers, upmixing techniques for specific types of conversions have been developed. An often investigated problem is how to convert 2-channel stereophonic audio for reproduction with 5-channel surround loudspeaker systems. One approach or implementation to such a 2-to-5 upmix is to use a so-called "matrix" decoder. Such decoders have become common to provide or upmix 5.1 multi-channel sound over stereo transmission infrastructures, especially in the early days of surround sound for movies and home theatres. The basic idea is to reproduce sound components which are in-phase in the stereo signal in the front of the sound image, and to put out-of-phase components into the rear loudspeakers. An alternative 2-to-5 upmixing method proposes to extract the ambient components of the stereo signal and to reproduce those components via the rear loudspeakers of the 5.1 setup. An approach following the same basic ideas on a perceptually more justified basis and using a mathematically more elegant implementation has been recently proposed by C. Faller in "Parametric Multi-channel Audio Coding: Synthesis of Coherence Cues", IEEE Trans. On Speech and Audio Proc., vol. 14, no. 1, Jan. 2006.

The recently published standard MPEG surround performs an upmix from one or two downmixed and transmitted channels to the final channels used in reproduction or playback, which is usually 5.1. This is implemented either using spatial side information (side information similar to the BCC technique) or without side information, by using the phase relations between the two channels of a stereo downmix ("non-guided mode" or "enhanced matrix mode").

All methods for format conversion described in the previous paragraphs are specialized to be applied to specific configurations of both the source and the destination audio reproduction format and are thus not universal. That is, a conversion between arbitrary input multi-channel representations to arbitrary output multi-channel representations cannot be performed. That is to say the prior art transformation techniques are specifically tailored to the number of loudspeakers and their precise position for the input multi-channel audio representation as well as for the output multi-channel representation.

It is, naturally, desirable to have a concept for multi-channel transformation which is applicable to arbitrary combinations of input and output multi-channel representations.

SUMMARY OF THE INVENTION

According to one embodiment of the present invention, an apparatus for conversion of an input multi-channel representation into a different output multi-channel representation of a spatial audio signal comprises: an analyzer for deriving an intermediate representation of the spatial audio signal, the intermediate representation having direction parameters indicating a direction of origin of a portion of the spatial audio signal; and a signal composer for generating the output multi-channel representation of the spatial audio signal using the intermediate representation of the spatial audio signal.

In that an intermediate representation is used which has direction parameters indicating a direction of origin of a portion of the spatial audio signal, conversion can be achieved between arbitrary multi-channel representations, as long as the loudspeaker configuration of the output multi-channel representation is known. It is important to note that the loudspeaker configuration of the output multi-channel representation does not have to be known in advance, that is, during the design of the conversion apparatus. As the conversion apparatus and method are universal, a multi-channel representation provided as an input multi-channel representation and designed for a specific loudspeaker-setup may be altered on the receiving side, to fit the available reproduction setup such that the reproduction quality of a reproduction of a spatial audio signal is enhanced.

According to a further embodiment of the present invention, the direction of origin of a portion of the spatial audio signal is analyzed within different frequency bands. Such, different direction parameters are derived for finite with frequency portions of the spatial audio signal. To derive the finite width frequency portions, a filterbank or a Fourier-transform may, for example, be used. According to another embodiment, the frequency portions or frequency bands, for which the analysis is performed individually is chosen to match the frequency resolution of the human hearing process. These embodiments may have the advantage that the direction of origin of portions of the spatial audio signal is performed as good as the human auditory system itself can determine the direction of origin of audio signals. Therefore, the analysis is performed without a potential loss of precision in the determination of the origin of an audio object or a signal portion, when a such analyzed signal is reconstructed and played back via an arbitrary loudspeaker setup.

According to a further embodiment of the present invention, one or more downmix channels are additionally derived belonging to the intermediate representation. That is, downmixed channels are derived from audio channels corresponding to loudspeakers associated to the input multi-channel representation, which may then be used for generating the output multi-channel representation or for generating audio channels corresponding to loudspeakers associated to the output multi-channel representation.

For example, a monophonic downmix a channel may be generated from the 5.1 input channels of a common 5.1 channel audio signal. This could, for example, be performed by computing the sum of all the individual audio channels. Based on the such derived monophonic downmix channel, a signal composer may distribute such portions of the monophonic downmix channel corresponding to the analyzed portions of the input multi-channel representation to the channels of the output multi-channel representation as indicated by the direction parameters. That is, a frequency/time or signal portion analyzed to be coming from the far left from a spatial audio signal will be redistributed to the loudspeakers of the output multi-channel representation, which are located on the left side with respect to a listening position.

Generally, some embodiments of the present invention allow to distribute portions of the spatial audio signal with greater intensity to a channel corresponding to a loudspeaker closer to the direction indicated by the direction parameters than to a channel further away from that direction. That is, no matter how the location of loudspeakers used for reproduction are defined in the output multi-channel representation, a spatial redistribution will be achieved fitting the available reproduction setup as good as possible.

According to some embodiments of the present invention, a spatial resolution, with which a direction of origin of a portion of the spatial audio signal can be determined, is much higher than the angle of three dimensional space associated to one single loudspeaker of the input multi-channel representation. That is, the direction of origin of a portion of the spatial audio signal can be derived with a better precision than a spatial resolution achievable by simply redistributing the audio channels from one distinct setup to another specific setup, as for example by redistributing the channels of a 5.1 setup to a 7.1 or 7.2 setup.

Summarizing, some embodiments of the invention allow the application of an enhanced method for format conversion which is universally applicable and does not depend on a particular desired target loudspeaker layout/configuration. Some embodiments convert an input multi-channel audio format (representation) with N1 channels into an output multi-channel format (representation) having N2 channels by means of extracting direction parameters (similar to DirAC), which are then used for synthesizing the output signal having N2 channels. Furthermore, according to some embodiments, a number of N0 downmix channels are computed from the N1 input signals (audio channels corresponding to loudspeakers according to the input multi-channel representation), which are then used as a basis for a decoding process using the extracted direction parameters.

BRIEF DESCRIPTION OF THE DRAWINGS

Several embodiments of the present invention will in the following be described referencing the enclosed drawings.

Some embodiments of the present invention derive an intermediate representation of a spatial audio signal having direction parameters indicating a direction of origin of a portion of the spatial audio signal. One possibility is to derive a velocity vector indicating the direction of origin of a portion of a spatial audio signal. One example for doing so will be described in the following paragraphs, referencing FIG. 1.

Figure 1:
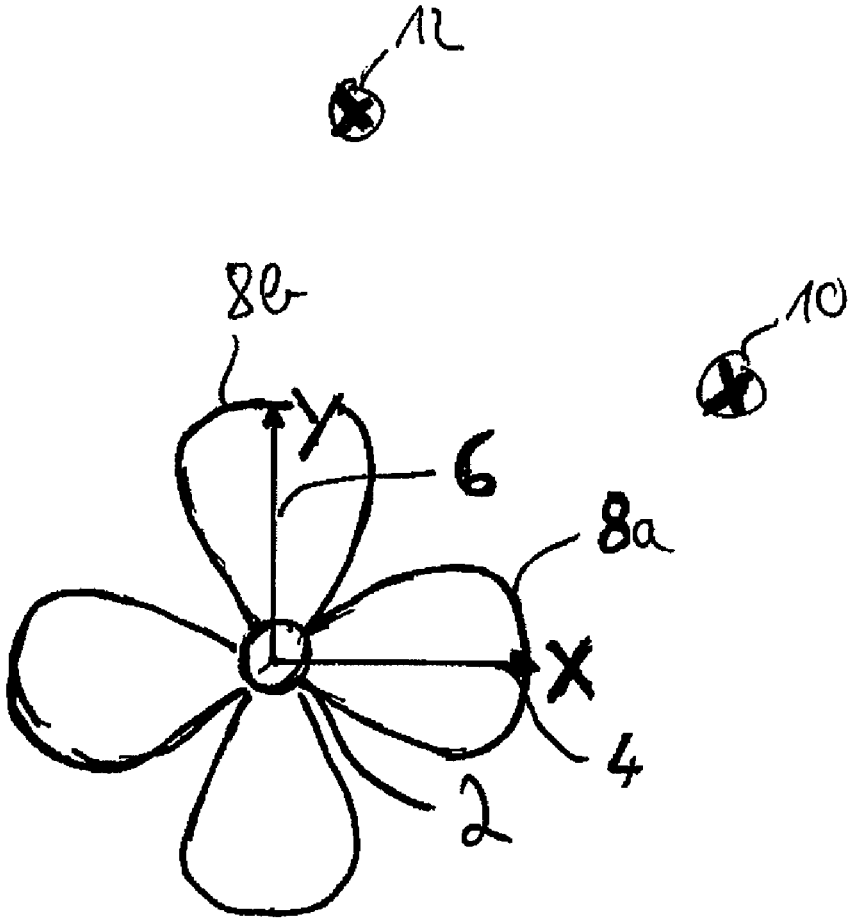
FIG. 1 shows an illustration of derivation of direction parameters indicating a direction of origin of a portion of an audio signal.

Before detailing the concept, it may be noted that the following analysis may be applied to multiple individual frequency or time portions of the underlying spatial audio signal simultaneously. For the sake of simplicity, however, the analysis will be described for one specific frequency or time or time/frequency portion only. The analysis is based on an energetic analysis of the sound field recorded at a recording position 2, located at the center of a coordinate system, as indicated in FIG. 1.

The coordinate system is a Cartesian Coordinate System, having an x axis 4 and a y axis 6 perpendicular to each other. Using a right handed system, the z axis not shown in FIG. 1 points to the direction out of the drawing plane.

For the direction analysis, it is assumed that 4 signals (known as B-format signals) are recorded. One omnidirectional signal w is recorded, i.e. a signal receiving signals from all directions with (ideally) equal sensitivity. Furthermore, three directional signals X, Y and Z are recorded, having a sensitivity distribution pointing in the direction of the axes of the Cartesian Coordinate System. Examples for possible sensitivity patterns of the microphones used are given in FIG. 1 showing two "figure-of-eight" patterns 8*a* and 8*b*, pointing to the directions of the axes. Two possible audio sources 10 and 12 are furthermore illustrated in the two-dimensional projection of the coordinate system shown in FIG. 1.

For the direction analysis, an instantaneous velocity vector (at time index n) is composed for different frequency portions (described by the index i) by $$v(n,i)=X(n,i)e_x+Y(n,i)e_y+Z(n,i)e_z. \tag{1}$$

That is, a vector is created having the individually recorded microphone signals of the microphones associated to the axis of the coordinate system as components. In the previous and the following equations, the Quantities are indexed in Time (n) as well as in frequency (i) by two indices (n, i). That is, $e_x$, $e_y$ and $e_z$ represent Cartesian unit vectors.

Using the simultaneously recorded omnidirectional signal w, an instantaneous intensity I is computed as $$I(n,i)=w(n,i)v(n,i), \tag{2}$$

the instantaneous energy is derived according to the following formula:

$$E(n,i)=w^2(n,i)+\|v\|^2(n,i), \tag{3}$$

where $\|\ \|$ denotes vector norm.

That is, an intensity quantity is derived allowing for possible interference between two signals (as positive and negative amplitudes may occur). Additionally, an energy quantity is derived, which naturally does not allow for interference between two signals, as the energy quantity does not contain negative values allowing for an cancellation of the signal.

These properties of the intensity and the energy signals can be advantageously used to derive a direction of origin of signal portions with high accuracy, preserving a virtual correlation of audio channels (a relative phase between the channels), as it will be detailed below.

On the one hand, the instantaneous intensity vector may be used as vector indicating the direction of origin of a portion of the spatial audio signal. However, this vector may undergo rapid changes thus causing artifacts within the reproduction of the signal. Therefore, alternatively, an instantaneous direction may be computed using short time averaging utilizing a Hanning window $W_2$ according to the following formula:

$$D(n,\ i) = -\sum_{m=-M/2}^{M/2} I(n+m,\ i)W_2(m), \tag{4}$$

where $W_2$ is the Hanning window for short-time averaging D.

That is, optionally, a short-time averaged direction vector having parameters indicating a direction of origin of the spatial audio signal may be derived.

Optionally, a diffuseness measure ψ may be computed as follows:

$$\psi(n,\ i) = 1 - \frac{\sqrt{\sum_{m=-M/2}^{M/2} \|I(n+m,\ i)\|^2 W_1(m)}}{\sum_{m=-M/2}^{M/2} E(n+m,\ i)W_1(m)} \tag{5}$$

where $W_1(m)$ is a window function defined between −M/2 and M/2 for short-time averaging.

It should again be noted that the deriving is performed such as to preserve virtual correlation of the audio channels. That is, phase information is properly taken into account, which is not the case for direction estimates based on energy estimates only (as for example Gerzon vectors).

The following simple example shall serve to explain this in more detail. Consider a perfectly diffuse signal which is played back by two loudspeakers of a stereo system. As the signal is diffuse (originating from all directions), it is to be played back by both speakers with equal intensity. However, as the perception shall be diffuse, a phase shift of 180 degrees is required. In such a scenario, a purely energy based direction estimation would yield a direction vector pointing exactly to the middle between the two loudspeakers, which certainly is a undesirable result not reflecting reality.

According to the inventive concept detailed above, virtual correlation of the audio channels is preserved while estimating the direction parameters (direction vectors). In this particular example, the direction vector would be zero, indicating that the sound does not originate from one distinct direction, which is clearly not the case in reality. Correspondingly, the diffuseness parameter of equation (5) is 1, matching the real situation perfectly.

The Hanning windows in the above equations may furthermore have different lengths for different frequency bands.

As a result of this analysis, for each time slice of a frequency portion, a direction vector or direction parameters are derived indicating a direction of origin of the portion of the spatial audio signal, for which the analysis has been performed. Optionally, a diffuseness parameter can be derived indicating the diffuseness of the direction of a portion of the spatial audio signal. As previously described, a diffusion value of one derived according to equation (4) describes a signal of maximal diffuseness, i.e. originating from all directions with equal intensity.

To the contrary, small diffuseness values are attributed to signal portions originating predominantly from one direction.

Figure 2:
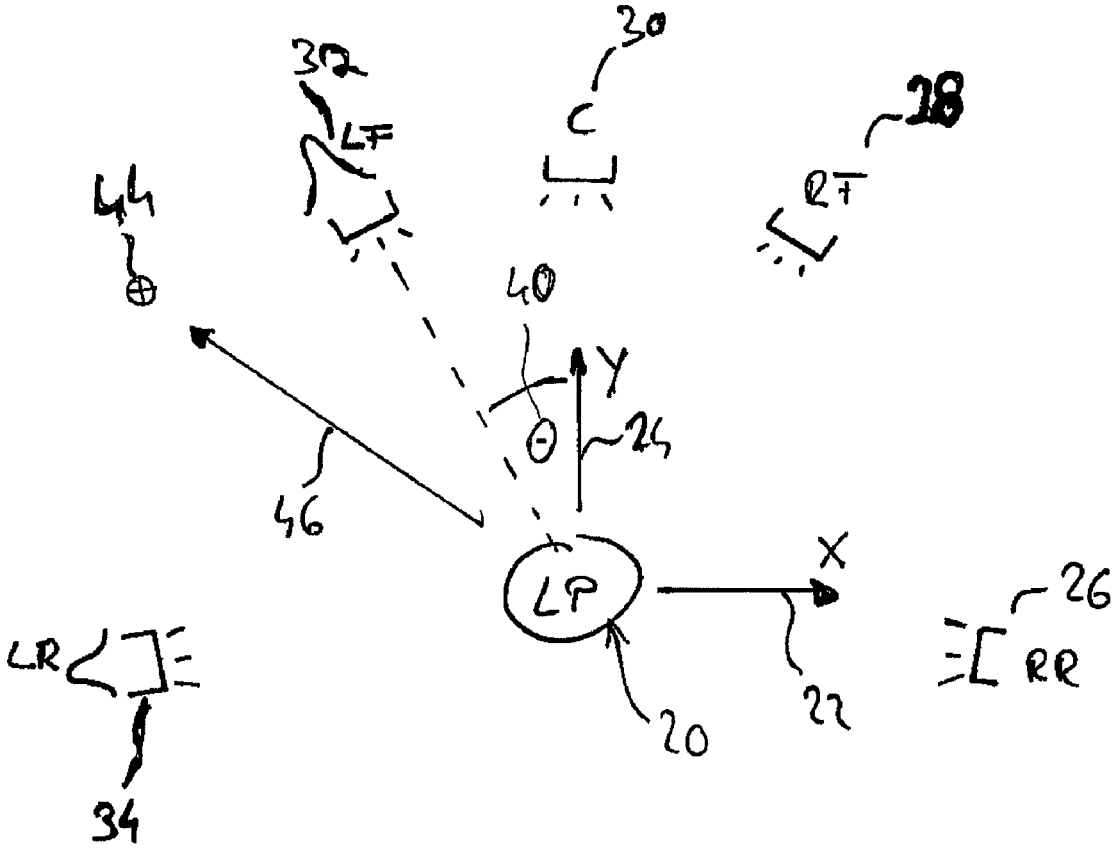
FIG. 2 shows a further embodiment of derivation of direction parameters based on a 5.1-channel representation.

FIG. 2 shows an example for the derivation of direction parameters from an input multi-channel representation having five channels according to ITU-775-1. The multi-channel input audio signal, i.e. the input multi-channel representation, is first transformed into B-format by simulating an anechoic recording of the corresponding multi-channel audio setup. With respect to a center 20 of the Cartesian Coordinate System having an axis x 22 and y 24, a rear-right loudspeaker 26 is located at an angle of 110°. A right-front loudspeaker 28 is located at +30°, a center loudspeaker at 0°, a left-front loudspeaker 32 at −31° and a left-rear loudspeaker 34 at −110°. In practice, an anechoic recording can be simulated by applying simple matrixing operations, the geometrical setup of the input multi-channel representation is known.

An omnidirectional signal w can be obtained by taking a direct sum of all loudspeaker signals, that is of all audio channels corresponding to the loudspeakers associated to the input multi-channel representation. The dipole or "figure-of-eight" signals X, Y and Z can be formed by adding the loudspeaker signals weighted by the cosine of the angle between the loudspeaker and the corresponding Cartesian axes, i.e. the direction of maximum sensitivity of the dipole microphone to be simulated. Let Ln be the 2-D or 3-D Cartesian vector pointing towards the nth loudspeaker and V be the unit vector pointing to the Cartesian axis direction corresponding to the dipole microphone. Then, the weighting factor is cos(angle (Ln, V)). The directional signal X would, for example, be written as $$X = \sum_{n=1}^{N} C_n \cdot \cos(\text{angle}(L_n, V)),$$

when $C_n$ denotes the loudspeaker signal of the nth channel and N is the number of channels. The term angle has to be interpreted as an operator, computing the spatial angle between the two given vectors. That is, for example the angle 40 (Θ) between the Y axis 24 and the left-front loudspeaker 32 in the two dimensional case illustrated in FIG. 2.

The further derivation of direction parameters could, for example, be performed as illustrated in FIG. 1 and detailed in the corresponding description, i.e. audio signals X, Y and Z can be divided into frequency bands according to frequency resolution of the human auditory system. The direction of the sound, i.e. the direction of origin of the portions of the spatial audio signal and, optionally, diffuseness is analyzed depending on time in each frequency channel. Optionally, a replacement for sound diffuseness using another measure of signal dissimilarity than diffuseness can also be used, such as the coherence between (stereo) channels associated to the spatial audio signal.

If, as a simplified example, one audio source 44 is present, as indicated in FIG. 2, wherein that source only contributes to the signal within a specific frequency band, a direction vector 46 pointing to the audio source 44 would be derived. The direction vector is represented by direction parameters (vector components) indicating the direction of the portion of the spatial audio signal originating from audio source 44. In the reproduction setup of FIG. 2, such a signal would be reproduced mainly by the left-front loudspeaker 32 as illustrated by the symbolic wave form associated to this loudspeaker. However, minor signal portions will also be played back from the left-rear loudspeaker 32. Hence, the directional signal of the microphone associated to the X coordinate 22 would receive signal components from the left-front channel 32 (the audio channel associate to the left-front loudspeaker 32) and the left-rear channel 34.

As, according to the above implementation, the directional signal Y associated to the y-axis will receive also signal portions played back by the left-front loudspeaker 32, a directional analysis based on directional signals X and Y will be able to reconstruct sound coming from direction vector 46 with high precision.

For the final conversion to the desired multi-channel representation (multi-channel format), the direction parameters indicating the direction of origin of portions of the audio signals are used. Optionally, one or more (N0) additional audio downmix channels may be used. Such a downmix channel may, for example, be the omnidirectional channel W or any other monophonic channel. However, for the spatial distribution, the use of only one single channel associated to the intermediate representation is of minor negative impact. That is, several downmix channels, such as a stereo mix, the channels W, X and Y or all channels of a B-format may be used as long as the direction parameters or the directional data has been derived and can be used for the reconstruction or the generation of the output multi-channel representation. It is alternatively also possible to use the 5 channels of FIG. 2 directly or any combination of channels associated to the input multi-channel representation as replacement for possible downmix channels. When only one channel is stored, there might be a degradation of the quality in the reproduction of diffuse sound.

Figure 3:
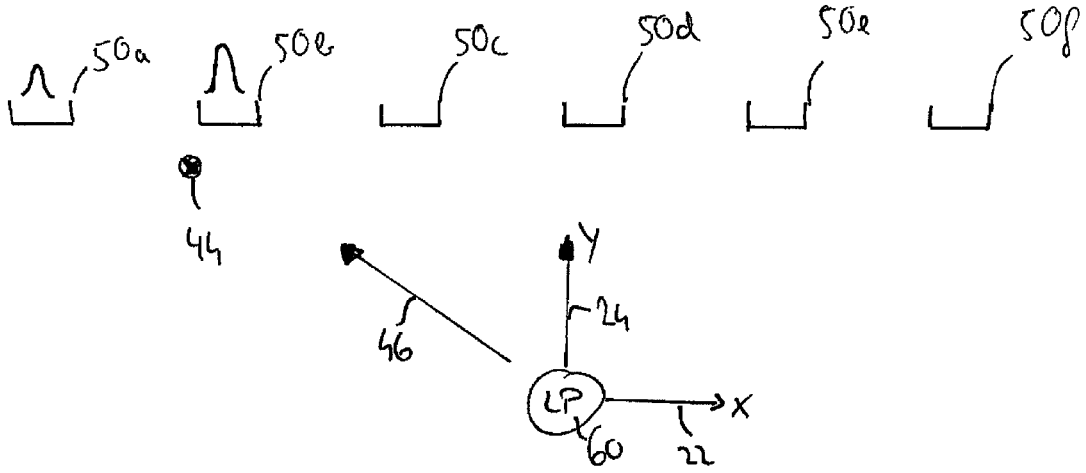
FIG. 3 shows an example of generation of an output multi-channel representation.

FIG. 3 shows an example for the reproduction of the signal of audio source 44 with a loudspeaker-setup differing significantly from the loudspeaker-setup of FIG. 2, which was the input multi-channel representation from which the parameters have been derived. FIG. 3 shows, as an example, six loudspeakers 50*a* to 50*f* equally distributed along a line in front of a listening position 60, defining the center of a coordinate system having an x-axis 22 and a y-axis 24, as introduced in FIG. 2. As a previous analysis has provided direction parameters describing the direction of the direction vector 46 pointing to the source of the audio signal 44, an output multi-channel representation adapted to the loudspeaker setup of FIG. 3 can easily be derived by redistributing the portion of the spatial audio signal to be reproduced to the loudspeakers close to the direction of audio source 44, i.e. by those loudspeakers close to the direction indicated by the direction parameters. That is, audio channels corresponding to loudspeakers in the direction indicated by the direction parameters are emphasized with respect to audio channels corresponding to loudspeakers far away from this direction. That is, loudspeakers 50*a* and 50*b* can be steered (for example using amplitude panning) to reproduce the signal portion, whereas loudspeakers 50*c* to 50*f* do not reproduce that specific signal portion, while they may be used for reproduction of diffuse sound or other signal portions of different frequency bands.

The use of a signal composer for generating the output multi-channel representation of the spatial audio signal using the direction parameters can also be interpreted as being a decoding of the intermediate signal into the desired multi-channel output format having N2 output channels. Audio downmix channels or signals generated are typically processed in the same frequency band as they have been analyzed in. Decoding may be performed in a manner similar to DirAC. In the optional reproduction of diffuse sound, the audio use for representing a non-diffuse stream is typically either one of the optional N0 downmix channel signals or linear combinations thereof.

For the optional creation of a diffuse stream, several synthesis options exist to create the diffuse part of the output signals or the output channels corresponding to loudspeakers according to the output multi-channel representation. If there is only one downmix channel transmitted, that channel has to be used to create non-diffuse signals for each loudspeaker. If there are more channels transmitted, there are more options how diffuse sound may be created. If, for example, a stereo downmix is used in the conversion process, an obviously suited method is to apply the left downmix channel to the loudspeakers on the left and the right downmix channel to the loudspeakers on the right side. If several downmix channels are used for the conversion (i.e. N0>1), the diffuse stream for each loudspeaker can be computed as a differently weighted sum of these downmix channels. One possibility could, for example, be transmitting a B-format signal (channels X, Y, Z and w as previously described) and computing the signal of a virtual cardioid microphone signal for each loudspeaker.

Figure 4:
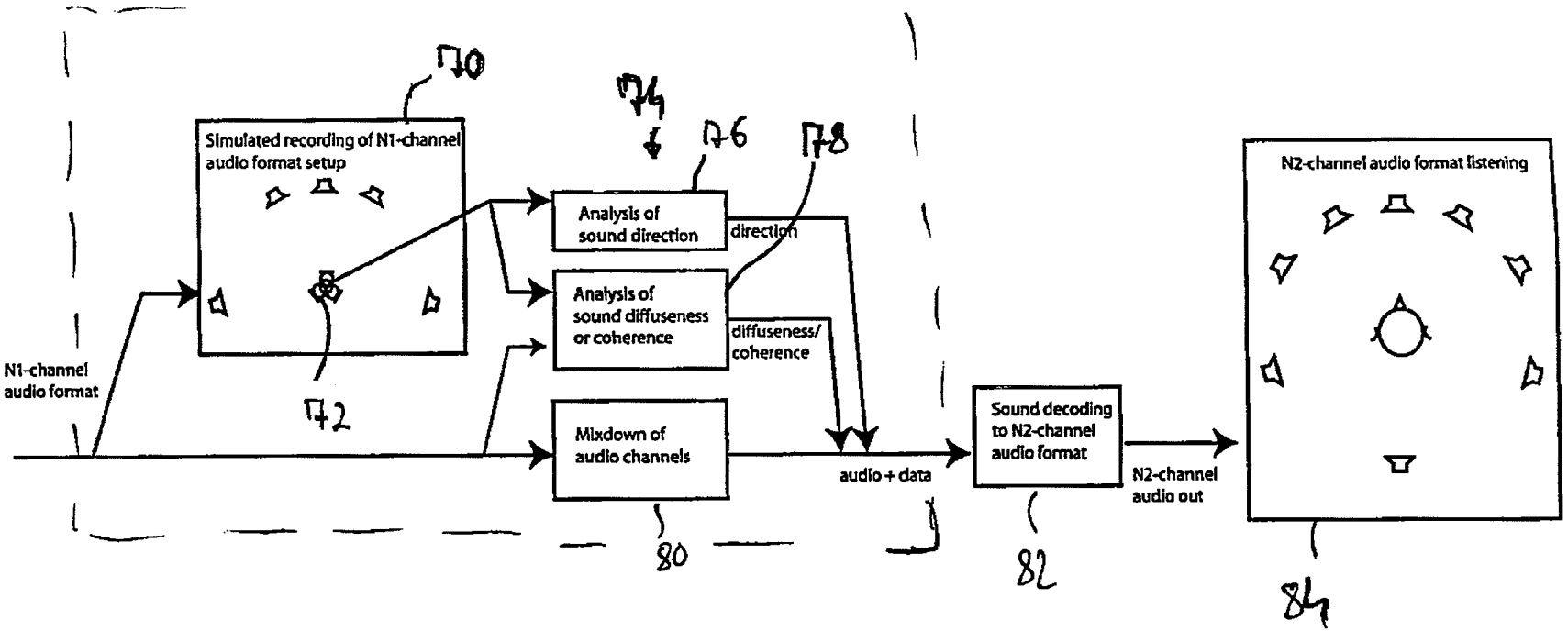
FIG. 4 shows an example for audio conversion from a 5.1-channel setup to an 8.1 channel setup.

The following text describes a possible procedure for the conversion of an input multi-channel representation into an output multi-channel representation as a list. In this example, sound is recorded with a simulated B-format microphone and then further processed by a signal composer for listening or playing back with a multi-channel or a monophonic loudspeaker setup. The single steps are explained referencing FIG. 4 showing a conversion of a 5.1-channel input multi-channel representation into an 8-channel output multi-channel representation. The basis is a N1-channel audio format (N1 being 5 in the specific example). To convert the input multi-channel representation into a different output multi-channel representation the following steps may be performed.

1. Simulate an anechoic recording of an arbitrary multi-channel audio representation having N1 audio channels (5 channels), as illustrated in the recording section 70 (with a simulated B-format microphone in a center 72 of the layout).

2. In an analysis step 74, the simulated microphone signals are divided into frequency bands and in a directional analysis step 76, the direction of origin of portions of the simulated microphone signals are derived. Furthermore, optionally, diffuseness (or coherence) may be determined in a diffuseness termination step 78.

As previously mentioned a direction analysis may be performed without using a B-format intermediate step. That is, generally, an intermediate representation of the spatial audio signal has to be derived based on an input multi-channel representation, wherein the intermediate representation has direction parameters indicating a direction of origin of a portion of the spatial audio signal.

3. In a downmix step 80, N0 downmix audio signals are derived, to be used as the basis for the conversion/the creation of the output multi-channel representation. In a composition step 82, the N0 downmix audio signals are decoded or upmixed to an arbitrary loudspeaker setup requiring N2 audio channels by an appropriate synthesis method (for example using amplitude panning or equally suitable techniques).

The result can be reproduced by a multi-channel loudspeaker system, having for example 8 loudspeakers as indicated in the playback scenario 84 of FIG. 4. However, thanks to the universality of the concept, a conversion may also be performed to a monophonic loudspeaker setup, providing an effect as if the spatial audio signal had been recorded with one single directional microphone.

Figure 5:
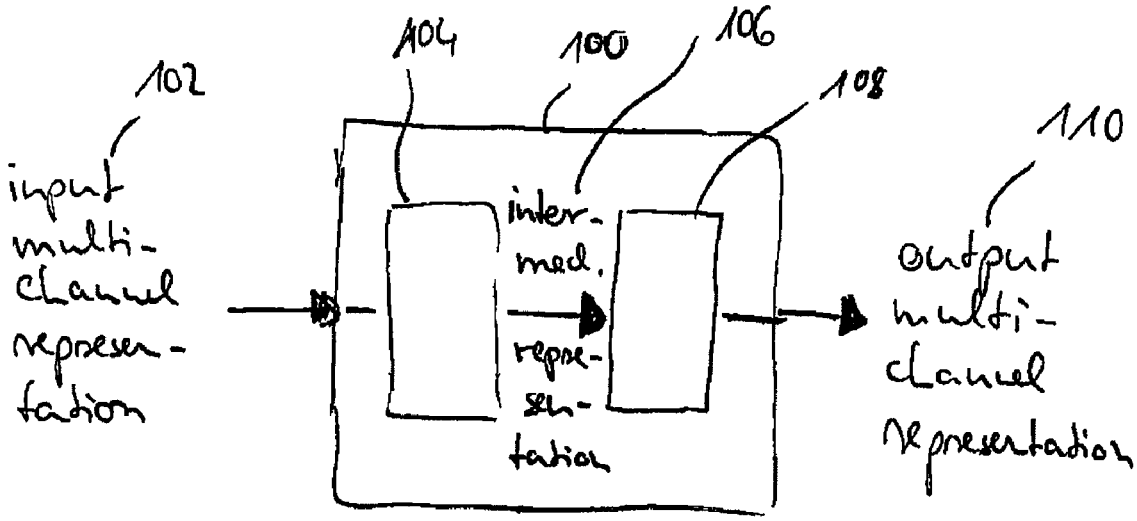
FIG. 5 shows an example for an inventive apparatus for conversion between multi-channel audio formats.

FIG. 5 shows a principle sketch of an example for an apparatus for conversion between multi-channel audio formats 100.

The Apparatus 100 for receives an input multi-channel representation 102.

The Apparatus 100 comprises an analyzer 104 for deriving an intermediate representation 106 of the spatial audio signal, the intermediate representation 106 having direction parameters indicating a direction of origin of a portion of the spatial audio signal.

The Apparatus 100 furthermore comprises a signal composer 108 for generating a output multi-channel representation 110 of the spatial audio signal using the intermediate representation (106) of the spatial audio signal.

Summarizing, the embodiments of the conversion apparatuses and conversion methods previously described provide some great advantages. First of all, virtually any input audio format can be processed in this way. Moreover, the conversion process can generate output for any loudspeaker layout, including non-standard loudspeaker layout/configurations without the need to specifically tailor new relations for new combinations of input loudspeaker layout/configurations and output loudspeaker layout/configurations. Furthermore, the spatial resolution of audio reproduction increases when the number of loudspeakers is increased, contrary to prior art implementations.

Depending on certain implementation requirements of the inventive methods, the inventive methods can be implemented in hardware or in software. The implementation can be performed using a digital storage medium, in particular a disk, DVD or a CD having electronically readable control signals stored thereon, which cooperate with a programmable computer system such that the inventive methods are performed. Generally, the present invention is, therefore, a computer program product with a program code stored on a machine readable carrier, the program code being operative for performing the inventive methods when the computer program product runs on a computer. In other words, the inventive methods are, therefore, a computer program having a program code for performing at least one of the inventive methods when the computer program runs on a computer.

While the foregoing has been particularly shown and described with reference to particular embodiments thereof, it will be understood by those skilled in the art that various other changes in the form and details may be made without departing from the spirit and scope thereof. It is to be understood that various changes may be made in adapting to different embodiments without departing from the broader concepts disclosed herein and comprehended by the claims that follow.

What is claimed:

1. Apparatus for conversion of an input multi-channel representation into a different output multi-channel representation of a spatial audio signal, comprising:

an analyzer configured for deriving an intermediate representation of the spatial audio signal, the intermediate representation comprising direction parameters indicating a direction of origin of a portion of the spatial audio signal and at least one downmix channel; and a signal composer configured for generating the output multi-channel representation of the spatial audio signal using the intermediate representation of the spatial audio signal by performing an upmixing operation, wherein the at least one downmix channel and the direction parameters are used in the upmixing operation.

2. Apparatus in accordance with claim 1, in which the analyzer is operative to derive direction parameters depending on a virtual correlation of audio channels associated to the input multi-channel representation.

3. Apparatus in accordance with claim 1, in which the analyzer is operative to derive direction parameters preserving the relative phase information of audio channels associated to the input multi-channel representation.

4. Apparatus in accordance with claim 1, in which the analyzer is operative to derive different direction parameters for finite width frequency portions of the spatial audio signal.

5. Apparatus in accordance with claim 1, in which the analyzer is operative to derive different direction parameters for finite length time portions of the spatial audio signal.

6. Apparatus in accordance with claim 4, in which the analyzer is operative to derive the different direction parameters for finite length time portions of the spatial audio signal associated to the frequency portions, wherein the length of a first time portion associated to a first frequency portion differs from the length of a second time portion association to a second, different frequency portion of the spatial audio signal.

7. Apparatus in accordance with claim 1, in which the analyzer is operative to derive direction parameters describing a vector pointing to the direction of origin of the portion of the spatial audio signal.

8. Apparatus in accordance with claim 1, in which the analyzer is additionally operative to derive one or more audio channels associated to the intermediate representation.

9. Apparatus in accordance with claim 8, in which the analyzer is operative to derive audio channels corresponding to loudspeakers associated to the input multi-channel representation.

10. Apparatus in accordance with claim 8, in which the analyzer is operative to derive one downmix channel as sum of audio channels corresponding to loudspeakers associated to the input multi-channel representation.

11. Apparatus in accordance with claim 8, in which the analyzer is operative to derive at least one audio channel associated to the direction of an axis of a Cartesian Coordinate System.

12. Apparatus in accordance with claim 11, in which the analyzer is operative to derive the at least one audio channel building the weighted sum of audio channels corresponding to loudspeakers associated to the input multi-channel representation.

13. Apparatus in accordance with claim 11, in which the analyzer is operative such that the deriving of the at least one audio channel X associated to the direction V of an axis of the Cartesian Coordinate System can be described by a combination of n audio channels $C_n$ corresponding to all n loudspeakers associated to the input multi-channel representation and directed in a direction $C_n$, according to the following formula:

$$X = \sum_{n=1}^{N} C_n \cdot \cos(\text{angle}(L_n, V)).$$

14. Apparatus in accordance with claim 1, in which the analyzer is further operative to derive a diffuseness parameter indicating a diffuseness of the direction of origin of the portion of the spatial audio signal.

15. Apparatus in accordance with claim 1, in which the signal composer is operative to distribute the portion of the spatial audio signal to a number of channels corresponding to a number of loudspeakers associated to the output multi-channel representation.

16. Apparatus in accordance with claim 15, in which the signal composer is operative such that the portion of the spatial audio signal is distributed with greater intensity to a channel corresponding to a loudspeaker closer to the direction indicated by the direction parameters than to a channel corresponding to a loudspeaker further away from that direction.

17. Apparatus in accordance with claim 14, in which the signal composer is operative such that the portion of the spatial audio signal is distributed with more uniform intensity to channels corresponding to loudspeakers associated to the output multi-channel representation when the diffuseness parameter indicates higher diffuseness than when the diffuseness parameter indicates lower diffuseness.

18. Apparatus in accordance with claim 1 further comprising:

an input interface for receiving the input multi-channel representation.

19. Apparatus in accordance with claim 1 further comprising:

an input representation decoder for deriving a number of audio channels corresponding to all loudspeakers associated to the input multi-channel representation.

20. Apparatus in accordance with claim 15, in which the signal composer further comprises an output channel encoder for deriving the output multi-channel representation based on the audio channels corresponding to the loudspeakers associated to the output channel representation.

21. Apparatus in accordance with claim 1 further comprising an output interface for providing the output multi-channel representation.

22. Method for conversion of an input multi-channel representation into a different output multi-channel representation of a spatial audio signal, the method comprising:

deriving an intermediate representation of the spatial audio signal, the intermediate representation comprising direction parameters indicating a direction of origin of a portion of the spatial audio signal and at least one downmix channel; and generating the output multi-channel representation of the spatial audio signal using the intermediate representation of the spatial audio signal by performing an upmixing operation, wherein the at least one downmix channel and the direction parameters are used in the upmixing operation.

23. A non-transitory storage medium having stored thereon a computer program for, when running on a computer, implementing a method for conversion of a multi-channel representation into a different output multi-channel representation of a spatial audio signal, the method comprising:

deriving an intermediate representation of the spatial audio signal, the intermediate representation comprising direction parameters indicating a direction of origin of a portion of the spatial audio signal and at least one downmix channel; and generating the output multi-channel representation of the spatial audio signal using the intermediate representation of the spatial audio signal by performing an upmixing operation, wherein the at least one downmix channel and the direction parameters are used in the upmixing operation.

* * * * *